US005509879A

United States Patent [19]

Lanzagorta

[11] Patent Number: 5,509,879

[45] Date of Patent: Apr. 23, 1996

[54] PORTABLE EXERCISER WITH A CONSTANT RESISTANCE

[76] Inventor: Ignacio Lanzagorta, 5644 Westheimer #141, Houston, Tex. 77056-7788

[21] Appl. No.: 279,045

[22] Filed: Jul. 22, 1994

[51] Int. Cl.[6] ..... A63B 21/012

[52] U.S. Cl. ..... 482/120; 482/115; 482/119

[58] Field of Search ..... 482/114, 115, 482/118, 119, 120, 44, 45, 70, 54

[56] References Cited

U.S. PATENT DOCUMENTS

| | | | |
|---|---|---|---|
| 3,637,205 | 1/1972 | Bankston | 482/114 |
| 3,811,672 | 5/1974 | Simmons | 482/114 |
| 4,580,778 | 4/1986 | Van Noord | 482/114 |
| 4,844,449 | 7/1989 | Truslaske | 482/54 |
| 4,852,874 | 8/1989 | Sleichter, III et al. . | |
| 5,071,116 | 12/1991 | Minear | 482/129 |
| 5,092,582 | 3/1992 | Pertramer . | |
| 5,131,895 | 7/1992 | Rogers, Jr. | 482/70 |
| 5,232,425 | 8/1993 | Miller et al. . | |
| 5,242,340 | 9/1993 | Jerome . | |
| 5,267,929 | 12/1993 | Chen . | |

FOREIGN PATENT DOCUMENTS

| | | | |
|---|---|---|---|
| 0403165 | 12/1933 | United Kingdom | 482/114 |

*Primary Examiner*—Lynne A. Reichard
*Attorney, Agent, or Firm*—Baker & Botts

[57] ABSTRACT

A portable exerciser having an adjustable constant resistance to employment thereof. The exerciser includes a shaft and a housing slidably disposed on the shaft. A gear in the housing engages the shaft and a member frictionally engages the gear so that movement of the housing relative to the shaft rotates the gear against the friction force applied by the member.

18 Claims, 5 Drawing Sheets

PORTABLE EXERCISER WITH A CONSTANT RESISTANCE

FIELD OF THE INVENTION

This invention is related in general to the field of exercise equipment, and more particularly to a portable exerciser with a constant resistance that can be used for exercising many groups of muscles in the human body.

BACKGROUND OF THE INVENTION

Many conventional multi-function exercisers are not portable because they are too bulky to be carried. Conventional portable exercisers have several drawbacks stemming from the use of restoring force as resistance. The restoring force can be provided by a spring or elastic strap. When the spring or strap is deformed there is a risk that control of the device will be lost and an injury may be incurred. For instance, if the spring, handle, or strap broke or the user lost his grip on the handles, the conventional exerciser would have a violent change in resistance. Another drawback of conventional portable exercisers is that the restoring force is not constant; it changes as the spring or strap is stretched. A variable resistance does not allow the user to employ a smooth motion or experience a smooth feeling when employing the device.

Another drawback of conventional portable exercisers is that the restoring force can pinch the skin of the user. The spring or elastic strap is designed for use by a person of a specific size and cannot be comfortably employed by a user of a different size. Other conventional devices exercise only one group of muscles.

SUMMARY OF THE INVENTION

Accordingly, it is an object of the invention to provide a portable exerciser that is highly versatile and capable of being used in performing a wide variety of exercises. Another object of the present invention is to provide a device which is portable and easy to store. Another object of the present invention is to provide a device that has an adjustable resistance so that users of different strength can be accommodated. Another object of the present invention is to provide a device that can be comfortably used by people of different size. Another object of the present invention is to provide a device that exercises two groups of muscles with each repetition at different adjustable resistances. Another object of the present invention is to provide a device that has constant resistance. Another object of the present invention is to provide a device that can be adapted to perform aerobic exercise, muscle tone exercise, and strength training exercise to different groups of muscles, including: neck, arms, chest, back, legs, and thighs.

In accordance with the present invention a portable exercise device is provided that substantially eliminates or reduces disadvantages and problems associated with previously developed portable exercise devices.

The device includes a shaft slidably disposed through a housing. The housing includes a means for altering the friction between the housing and the shaft. Each end of the shaft has a stopper so that the housing cannot slide off the shaft. One of the stoppers has a handle as does the housing. In on embodiment, the handles can be substituted with other accessories The housing also includes rollers for engaging the shaft. The shaft is preferably rectangular in cross-section and includes a furrow, which in one embodiment is toothed along one side of its length.

In the preferred embodiment, the force for the displacement is applied to two hand-bars. One handle-bar is part of the housing and the other is part of a stopper attached to one end of a rigid shaft. The counter force is applied by the user.

An advantage of the present invention is that the exercise device is adjustable, light-weight, compact, and easy-to-use. Another advantage of the present invention is that the exercise resistance is a frictional resistance.

BRIEF DESCRIPTION OF THE DRAWINGS

For a more complete understanding of the present invention and advantages thereof, reference is now made to the following description taken in conjunction with the accompanying drawings in which like reference numbers indicate like features and wherein.

DETAILED DESCRIPTION OF THE INVENTION

Figure 1:
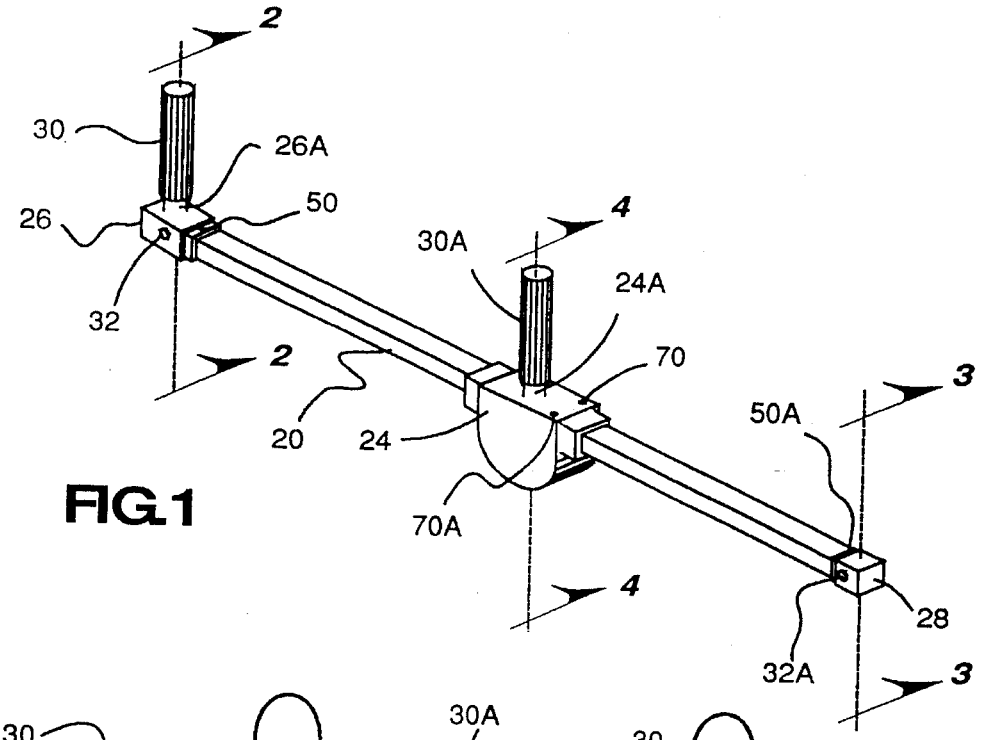
FIG. 1 illustrates a perspective view of a preferred embodiment of the present invention.

Referring to FIG. 1, a perspective, view of a preferred embodiment of the present invention is depicted. A rigid shaft 20 has a first end 22L and a second end 22R. The shaft 20 is preferably rectangular in cross-section, and is preferably fabricated with a rigid and light material such as aluminum. A housing 24 is slidably mounted around the shaft 20. The housing 24 is fabricated of a rigid material, preferably a metal, and made in one piece. A grip bar 24A is mounted upon the housing 24. A close-fitting grip sheath 30A encloses the grip bar 24A.

Figure 2:
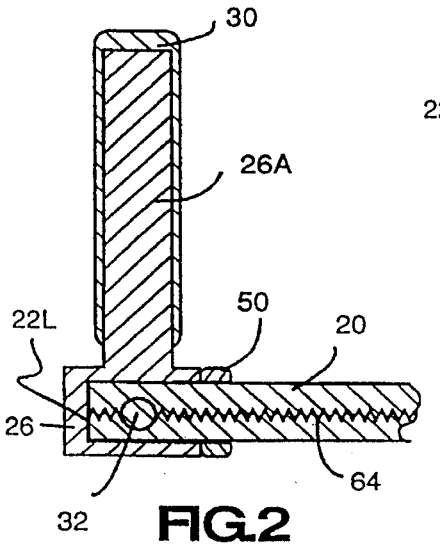
FIG. 2 illustrates a cross-sectional view taken about lines 2—2 of FIG. 1.
Figure 3:
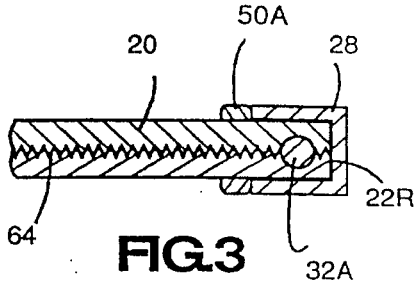
FIG. 3 illustrates a cross-sectional view taken about lines 3—3 of FIG. 1.

A first stopper 26 is coupled to the first end 22L of the shaft 20 (see FIG. 2) and a second stopper 28 is coupled to the second end 22R (see FIG. 3.) The stoppers 26, 28 are fabricated of a rigid material, preferably a metal. The stoppers 26, 28 prevent the shaft 20 from coming out of the housing 24. A grip bar 26A is mounted upon the first stopper 26 and is enclosed by a close-fitting grip sheath 30. Grip sheaths 30.30A are fabricated from a material which will provide durability and comfortable gripping, preferably a conventional polyurethane foam material.

A pad 50 is disposed in one embodiment the pad 50 is glued, on the shaft 20 adjacent the first stopper 26. A screw 32 secures the first stopper 26 to the first end 22L (see FIG. 2.) A pad 50A is disposed, in one embodiment the pad 50A is glued, on the shaft 20 adjacent the second stopper 28. A screw 32A secures the second stopper 28 to the second end 22R (see FIG. 3.) The pads 50, 50A prevent the housing 24 from colliding with either of the stoppers 26, 28.

Figure 4:
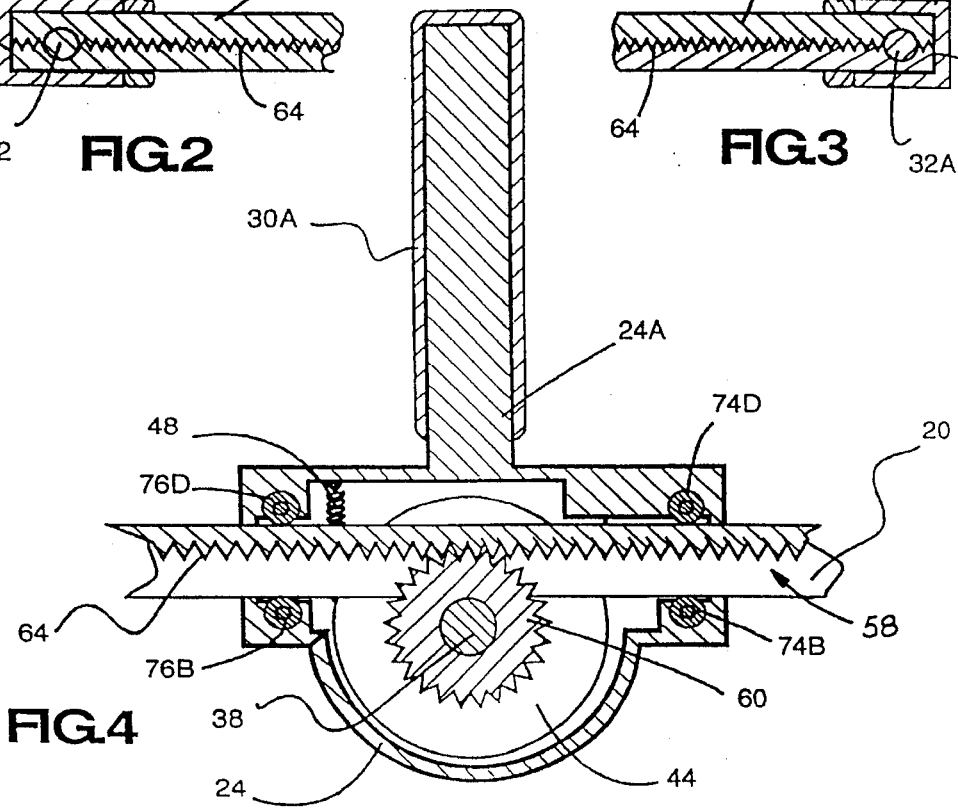
FIG. 4 illustrates a cross-sectional view taken about lines 4—4 of FIG. 1.

Referring to FIG. 4, a cross-sectional view taken about lines 4—4 of FIG. 1 is depicted. The housing 24 encloses a gear 60 mounted upon an axle 38. The gear 60 engages teeth 64 in a toothed furrow 58 on the shaft 20. Preferably, the device includes means for reducing friction 56 between the shaft 20 and the housing 24. In one embodiment, the reducing means comprises rollers 74A, 74B, 74C, 74D, 76A, 76B, 76C, 76D (see FIGS. 8 and 8A) that are mounted on the housing 24 and engage the shaft 20. A disk 44 is coupled to the axle 38. A spring 48 is coupled to the housing 24. When the relative displacement between shaft 20 and housing 24 occurs, the teeth 64 force the gear 60 to rotate such that the amount of force needed for the displacement of the housing 24 depends upon the rotational resistance of the gear 60.

Figure 5:
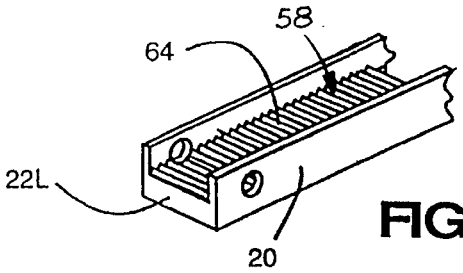
FIG. 5 illustrates a perspective view of an end of a shaft constructed according to the present invention.

Referring to FIG. 5, a perspective view of an end of a shaft constructed according to the present invention is depicted. The teeth 64 are disposed on one side of the shaft 20 in the toothed furrow 58. The shaft includes the first end 22L.

Figure 6:
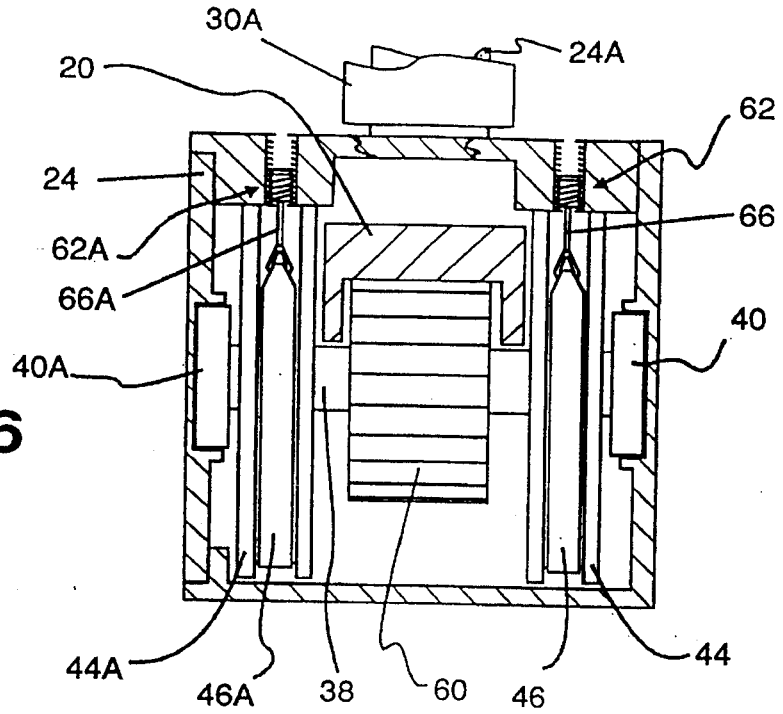
FIG. 6 illustrates a front view of a means for altering friction inside a housing constructed according to the present invention.

Referring to FIG. 6, a front view of a means for altering friction inside a housing constructed according to the present invention is depicted. The housing 24 encloses the axle 38 that is coupled to the gear 60, the disk 44, a disk 44A, and bearings 40, 40A. The bearings 40, 40A are mounted inside housing 24. The grip bar 24A is mounted upon the housing 24 and enclosed by the grip sheath 30A. The gear 60 engages the teeth 64 in the toothed furrow 58 on the shaft 20 which passes through the housing 24. A flexible band 46 engages the perimeter of the disk 44 and is coupled at one end to a flexible band tightening means 62 by a free rotation head 66. The flexible band tightening means 62 includes a threaded shaft 72 (see FIG. 7) and a hex key slot 68 (see FIG. 7.) A flexible band 46A engages the perimeter of disk 44A and is coupled at one end to a flexible band tightening means 62A by a free rotation head 66A. The flexible band tightening means 62A includes a threaded shaft 72A (see FIG. 7A) and, a hex key slot 68A (see FIG. 7A.)

Figure 6A:
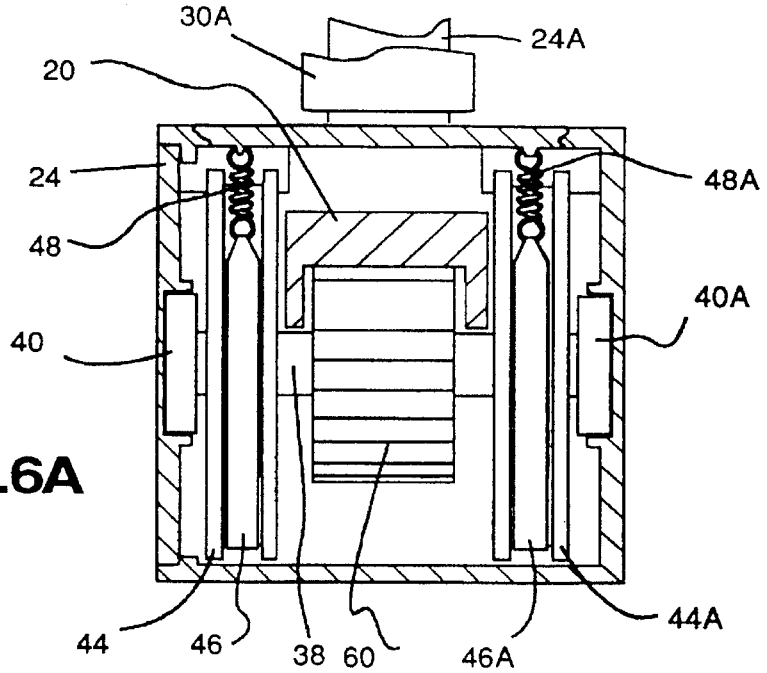
FIG. 6A illustrates a rear view of a means for altering friction inside a housing constructed according to the present invention.

Referring to FIG. 6A, a rear view of a means for altering friction inside a housing constructed according to the present invention is depicted. The housing 24 encloses the axle 38 that is coupled to the gear 60, the disks 44, 44A, and the bearings 40, 40A. The bearings 40, 40A are mounted inside housing 24. The grip bar 24A is mounted upon the housing 24 and enclosed by the grip sheath 30A. The gear 60 engages the teeth 64 in the toothed furrow 58 on the shaft 20 which passes through the housing 24. The flexible bands 46, 46A are each connected to the housing 24 by a spring 48, 48A.

Figure 7:
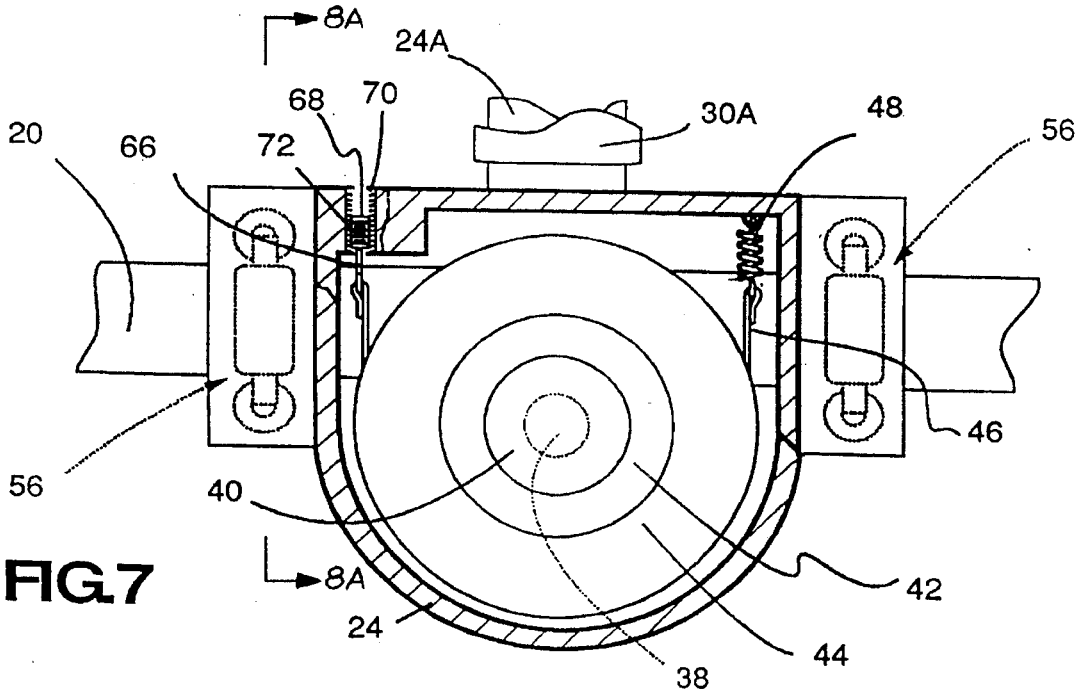
FIG. 7 illustrates a side view of a means for altering friction inside a housing constructed according to the present invention.

Referring to FIG. 7, a side view of a means for altering friction inside a housing constructed according to the present invention is depicted. The housing 24 encloses a means for altering the friction between the housing and the shaft, the means including the axle 38, the gear 60, the disk 44, and the flexible band 46. The axle 38 is connected to the gear 60, the disk 44 through first free-wheel unit 42, and the bearing 40. The first free-wheel unit 42 provides locking in the counterclockwise direction and free wheeling in the clockwise direction between the axle 38 and the disk 44. The disk 44 is only rotated by movement of the axle 38 in the counterclockwise direction. The grip bar 24A is mounted upon the housing 24 and enclosed by the grip sheath 30A. The gear 60 engages the teeth 64 in the toothed furrow 58 on the shall 20 which passes through the housing 24. The flexible band 46 engages the disk 44 and is connected to the housing 24 by the spring 48. The flexible band is also coupled to the threaded shall 72 by the free-rotation head 66. The free-rotation head 66 has a hole where band 46 is secured. The threaded shaft 72 has the hex key slot 68 at an upper end and is coiled within a threaded hole 70 that penetrates the housing 24. The ends of the threaded hole 70 narrow so that the threaded shaft 72 has limited displacement therein. The threaded shaft 72 is turned by a hex key that fits the hex key slot 68. When the shaft 20 moves relative to the housing 24 such that the gear 60 and axle 38 move in a counterclockwise direction, the disk 44 moves against the resistance of the friction of the flexible band 46. The friction of the flexible band 46 is adjusted by turning the threaded shaft 72. The means for reducing friction 56 are located between the shaft 20 and the housing 24.

Figure 7A:
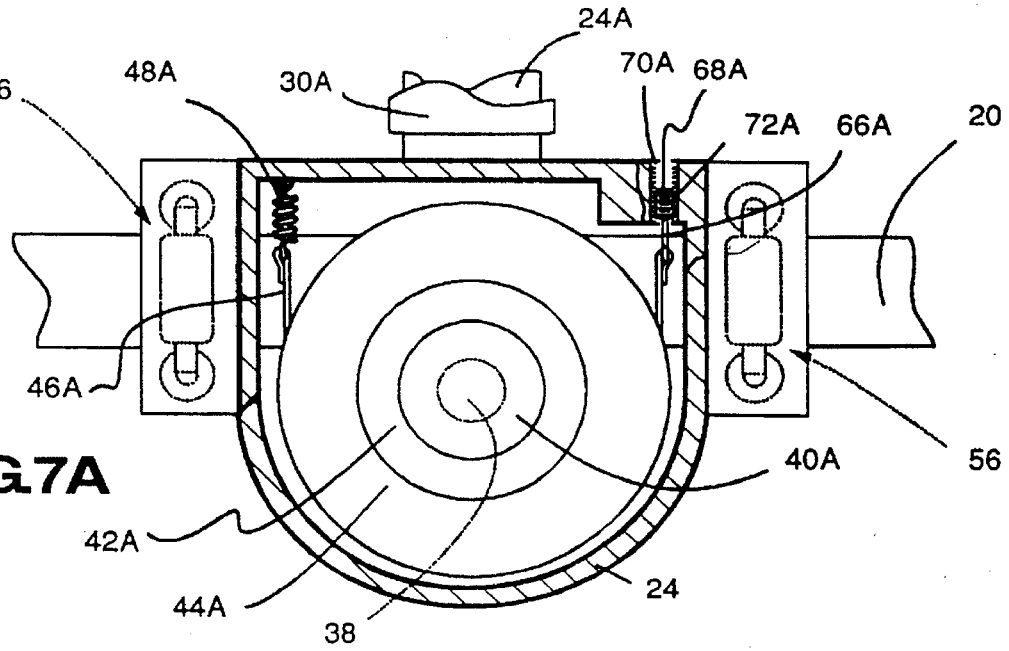
FIG. 7A illustrates a different side view of a means for altering friction inside a housing constructed according to the present invention.

Referring to FIG. 7A, a different side view of a means for altering friction inside a housing constructed according to the present invention is depicted. The housing 24 encloses the axle 38 that is connected to the gear 60, the disk 44A, the second free-wheel unit 42A and the bearing 40A. The second free-wheel unit 42A provides locking in the clockwise direction and free wheeling in the counterclockwise direction. The grip bar 24A is mounted upon the housing 24 and enclosed by the grip sheath 30A. The gear 60 engages the teeth 64 in the toothed furrow 58 on the shaft 20 which passes through the housing 24. The flexible band 46A engages the disk 44A and is connected to the housing 24 by the spring 48A. The flexible band is also coupled to the threaded shaft 72A by the free-rotation head 66A. The free-rotation head 66A has a hole where band 46A is secured. The threaded shaft 72A has the hex key slot 68A at an upper end and is coiled within a threaded hole 70A that penetrates the housing 24. The ends of the threaded hole 70A narrow so that the threaded shaft 72A has limited displacement therein. The threaded shaft 72A is turned by a hex key that fits the hex key slot 68A. When the shaft 20 moves relative to the housing 24 such that the gear 60 and axle 38 move in a clockwise direction, the disk 44A moves against the resistance of the friction of the flexible band 46A. The friction of the flexible band 46A is adjusted by turning the threaded shaft 72A. The means for reducing friction 56 are located between the shaft 20 and the housing 24.

Figure 8:
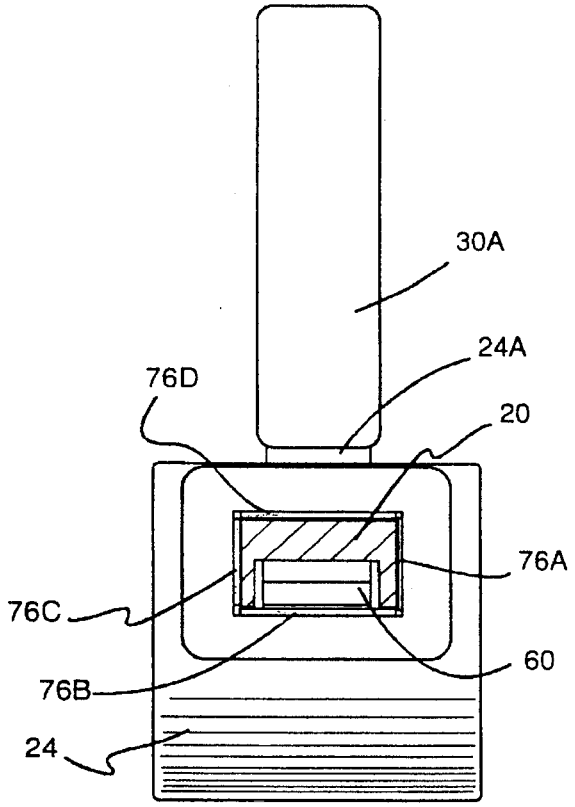
FIG. 8 shows the front view of the housing, where rollers are visible.

Referring to FIG. 8, the front view of the housing 24 where rollers 76A, 76B, 76C, 76D are visible is depicted. The housing 24 encloses the gear 60. The shaft 20 extends through the housing 24. The grip bar 24A is mounted upon the housing 24 and enclosed by the grip sheath 30A. Rollers 76A, 76B, 76C, 76D are mounted at an end of the housing 24 and engage the shaft 20.

Figure 8A:
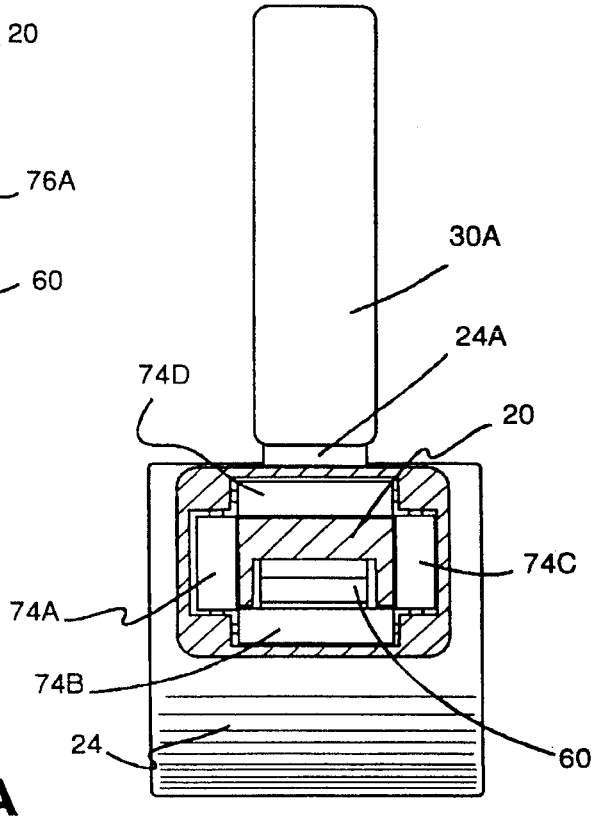
FIG. 8A shows a cross-sectional view taken about lines 8A—8A of FIG. 7 where rollers are visible.

Referring to FIG. 8A, a cross-sectional view taken about lines 8A—SA of FIG. 7, where rollers 74A, 74B, 74C, 74D are visible is depicted. The housing 24 encloses the gear 60. The shaft 20 extends through the housing 24. The grip bar 24A is mounted upon the housing 24 and enclosed by the grip sheath 30A. Rollers 74A, 74B, 74C, 74D are mounted at an end of the housing 24 and engage the shaft 20.

Figure 9:
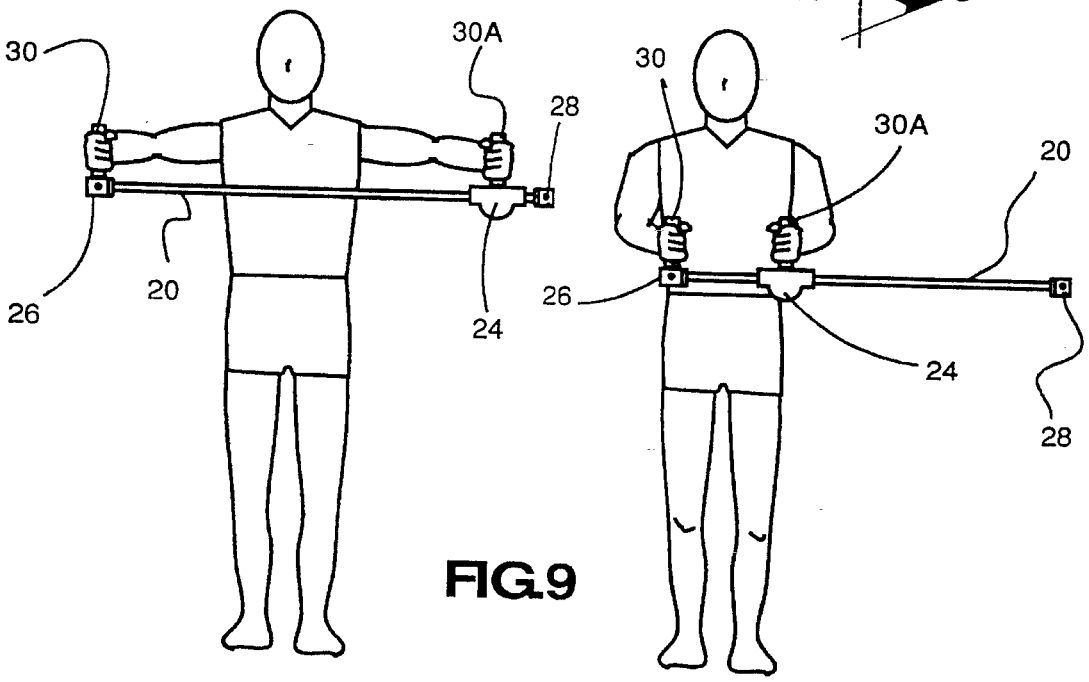
FIG. 9 illustrates use of an exercise device constructed according to the present invention.

Referring to FIG. 9, use of an exercise device constructed according to the present invention is depicted. The user grasps the exercise device by the grip sheaths 30, 30A. The user displaces the housing 24 relatively along the shaft 20 and toward the first stopper 26 The user then displaces the housing 24 relatively along the shaft 20 and toward the second stopper 28. The resistance overcome by the user is independently adjustable for each direction of displacement.

Although the present invention has been described in detail, it should be understood that various changes, substitutions and alterations can be made without departing from the spirit of the invention. In a modified embodiment, a shaft is attached to a platform occupied by a user and the force of displacement is applied to a bar attached to a housing that moves along the shaft.

In another modified embodiment, both ends of a shaft are secured to a surface with screws. The shaft can be very large and can be fabricated of stronger material without regard to weight.

In another modified embodiment, at least one end of a shaft is attached to a body portion of the user with a releasable coupling so that various muscles are exercised by the user. In another embodiment, a shaft with a toothless furrow is slidably disposed through a housing.

The scope of the invention is defined by the appended claims and their legal equivalents.

What is claimed is:

1. A portable exercise device comprising:

a housing;

a shaft slidably disposed through said housing;

a gear rotatably disposed within said housing, said gear engaging said shaft and rotating in a first direction when said housing moves in a second direction relative to said shaft;

a first member frictionally coupled to said gear when said gear rotates in the first direction;

a second member frictionally coupled to said gear when said gear rotates in a third direction and wherein said gear rotates in the third direction when said housing moves in a fourth direction relative to said shaft; and said first member is frictionlessly coupled to said gear when said gear rotates in the third direction.

2. The portable exercise device of claim 1 wherein said second member is frictionlessly coupled to said gear when said gear rotates in the first direction.

3. The portable exercise device of claim 1, wherein:

said first member is frictionally coupled in an adjustable manner to said gear when said gear rotates in a first direction and said second member is frictionally coupled in an adjustable manner to said gear when said gear rotates in a third direction.

4. A portable exercise device comprising:

a housing;

a shaft slidably disposed through said housing, wherein said shaft has a first end, a second end, a first stopper mounted on said first end and a second stopper mounted on said second end;

a gear rotatably disposed within said housing, said gear engaging said shaft and rotating in a first direction when said housing moves in a second direction relative to said shaft;

a first member frictionally coupled to said gear when said gear rotates in the first direction;

a first handle extending from said first stopper and a second handle extending from said housing.

5. A portable exercise device comprising:

a housing;

a shaft slidably disposed through said housing;

a gear rotatably disposed within said housing said gear engaging said shaft and rotating in a first direction when said housing moves in a second direction relative to said shaft;

a first member frictionally coupled to said gear when said gear rotates in the first direction; and a plurality of rollers mounted inside said housing for assisting said housing to slide along said shaft.

6. The portable exercise device of claim 5, wherein said shaft comprises a toothed furrow and said gear engages said toothed furrow.

7. A portable exercise device comprising:

a housing;

a shaft slidably disposed through said housing;

a gear rotatably disposed within said housing, said gear engaging said shaft and rotating in a first direction when said housing moves in a second direction relative to said shaft;

a first member frictionally coupled to said gear when said gear rotates in the first direction;

an axle fixedly coupled to said gear and a first disk fixedly coupled to said axle when said gear rotates in the first direction, said first disk frictionally coupled to said first member.

8. A portable exercise device comprising:

a shaft having a side and teeth disposed on said side;

a first handle fixedly disposed on said shaft; and a housing slidably disposed on said shaft and engaging said teeth, said housing having a second handle fixedly disposed thereon.

9. The portable exercise device of claim 8, wherein said shaft has a first end, a second end, a first stopper mounted on said first end and a second stopper mounted on said second end.

10. The portable exercise device of claim 8 further comprising:

a plurality of rollers mounted inside said housing for assisting said housing to slide along said shaft.

11. A portable exercise device comprising:

a shaft having a furrow;

a housing slidably moveable along said furrow of said shaft; and means for altering the friction between said housing and said shaft; and a plurality of rollers mounted inside said housing for assisting said housing to slide along said furrow of said shaft.

12. The portable exercise device of claim 11 wherein the altering means includes a gear.

13. The portable exercise device of claim 11 wherein the furrow includes teeth and the altering means includes a gear, said gear rotatably engaged with said teeth.

14. The portable exercise device of claim 13, wherein said gear rotates in a first direction when said housing moves in a second direction relative to said shaft and said altering means includes an axle fixedly coupled to said gear, a first disk fixedly coupled to said axle when said gear rotates in the first direction, and a first flexible band frictionally coupled to said first disk.

15. The portable exercise device of claim 14, wherein:

said first flexible band is frictionally coupled to said first disk in an adjustable manner.

16. The portable exercise device of claim 11, wherein said shaft has a first end, a second end, a first stopper mounted on said first end and a second stopper mounted on said second end.

17. A portable exercise device comprising:

a shaft having a furrow;

a housing slidably moveable along said furrow of said shaft; and means for altering the friction between said housing and said shaft, wherein the furrow includes teeth and the altering means includes a gear, said gear rotatably engaged with said teeth and wherein said gear rotates in a first direction when said housing moves in a second direction relative to said shaft and said altering means includes an axle fixedly coupled to said gear, a first disk fixedly coupled to said axle when said gear rotates in the first direction and a first flexible band frictionally coupled to said first disk.

18. The portable exercise device of claim 17, wherein:

said first flexible band is frictionally coupled to said first disk in an adjustable manner.

* * * * *

UNITED STATES PATENT AND TRADEMARK OFFICE

CERTIFICATE OF CORRECTION

PATENT NO. : 5,509,879
DATED : April 23, 1996
INVENTOR : Ignacio Lanzagorta

It is certified that error appears in the above-identified patent and that said Letters Patent is hereby corrected as shown below:

Column 4, line 8, "shall" should read -- shaft--.

Column 4, line 12, "shall" should read -- shaft--.

Column 4, line 60, "8A-SA" should read -- 8A-8A--.

Signed and Sealed this

Sixteenth Day of July, 1996

*Attest:*

*Attesting Officer*

BRUCE LEHMAN

*Commissioner of Patents and Trademarks*